US011156022B2

(12) United States Patent
Claeys et al.

(10) Patent No.: US 11,156,022 B2
(45) Date of Patent: Oct. 26, 2021

(54) TACK WITH FREE SPINNING FEATURE

(71) Applicants: Patrick Claeys, Weston, FL (US); Sergio M. Perez, Lake Worth, FL (US)

(72) Inventors: Patrick Claeys, Weston, FL (US); Sergio M. Perez, Lake Worth, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 0 days.

(21) Appl. No.: 16/749,529

(22) Filed: Jan. 22, 2020

(65) Prior Publication Data

US 2021/0087857 A1 Mar. 25, 2021

Related U.S. Application Data

(60) Provisional application No. 62/903,470, filed on Sep. 20, 2019.

(51) Int. Cl.
*E05B 73/00* (2006.01)
*G08B 13/24* (2006.01)

(52) U.S. Cl.
CPC ..... *E05B 73/0017* (2013.01); *G08B 13/242* (2013.01); *G08B 13/2434* (2013.01)

(58) Field of Classification Search
CPC ..... B65H 37/007; B65H 16/00; B65H 18/08; B32B 37/00; B32B 37/0053; B32B 37/26; B21D 51/32; B24B 5/42; B25B 23/1427; B41F 17/36; B67B 5/03; D03D 45/50; E06B 3/6733; E21B 17/07; E21B 7/14; G01N 2035/1086; G01N 35/1083; G01N 35/1095; G04C 17/0083; G06C 11/02; G11B 17/00; G11B 5/5521; Y10T 156/10; Y10T 156/1744; Y10T 74/18648; Y10T 74/18728; Y10T 82/19; A41H 37/008; B65C 7/005; B29C 64/106; B29C 64/118; B29C 64/321; B29C 70/70; B33Y 30/00; B33Y 50/02; A61B 17/00491; A61B 17/0057; A61B 17/12022; A61B 17/12118; A61B 17/12181; A61B 17/3468; A61B 18/02; A61B 18/04; A61B 18/1492; A61B 18/18; A61B 18/245; A61B 2017/00411; A61B 2017/00544; A61B 2017/0065; A61B 2017/00809; A61B 2017/00876; A61B 2017/1205; A61B 2017/22001; A61B 2018/00005; A61B 2018/00023; A61B 2018/00345; A61B 2018/00517; A61B 2018/00541; A61B 2018/00577;

(Continued)

(56) References Cited

U.S. PATENT DOCUMENTS 3,452,299 A 6/1969 Angel
4,831,372 A 5/1989 Riddoch (Continued)

*Primary Examiner* — Daniel Previl
(74) *Attorney, Agent, or Firm* — Arent Fox LLP

(57) ABSTRACT

Systems and methods for operating a security tag. The methods comprise: transitioning a pin head from an extended position to a collapsed position by causing at least one first telescoping segment to slidingly engage a second telescoping segment; locking a shaft, extending out and away from the pin head in the collapsed position, using a securement mechanism disposed inside a housing of the security tag; and preventing a transfer of pin head rotation to the shaft at least when the shaft is locked by the securement mechanism.

20 Claims, 15 Drawing Sheets

(58) Field of Classification Search
CPC A61B 2018/00595; A61B 2018/00982; A61B 2018/1861; A61B 2090/372; A61B 2090/378; A61B 2218/002; A61B 34/30; A61B 34/37; A61B 34/76; A61B 5/6843; A61B 8/00; A61B 8/4218; A61F 2002/9528; A61F 2210/009; A61F 2/013; A61F 2/82; A61F 2/95; A61M 16/104; A61M 37/00; A61N 2005/1011; A61N 2007/0008; A61N 7/00; A61N 7/02; B25J 15/0253; B25J 18/025; B25J 5/02; B25J 9/023; B65G 1/0407; B65G 1/0485; B65G 1/137; B65G 1/1371; B65G 2203/0233; B65G 2203/0283; G05B 15/02; G05B 2219/45083; G06Q 10/08
USPC ..... 340/572.9, 551, 572.3, 572.8, 568.1, 340/568.8, 571, 572.1, 683, 686.6, 825.36
See application file for complete search history.

(56) References Cited

U.S. PATENT DOCUMENTS

| | | | | |
|---|---|---|---|---|
| 5,583,478 | A | 12/1996 | Renzi | |
| 5,785,436 | A * | 7/1998 | Harrison | B44B 5/024 101/3.1 |
| 6,089,634 | A * | 7/2000 | Verhey | B66C 1/66 294/82.35 |
| 6,449,991 | B1 * | 9/2002 | Hogan | E05B 73/0017 24/600.7 |
| 7,391,327 | B2 * | 6/2008 | Ho | E05B 73/0017 335/284 |
| 8,013,667 | B2 | 9/2011 | Ikehashi | |
| 8,593,409 | B1 | 11/2013 | Heubel et al. | |
| 8,884,746 | B1 | 11/2014 | Cho et al. | |
| 9,101,818 | B2 * | 8/2015 | Carr | B67B 7/16 |
| 9,437,090 | B2 | 9/2016 | Easter et al. | |
| 9,715,804 | B1 | 7/2017 | Bergman et al. | |
| 9,830,791 | B2 | 11/2017 | Trivelpiece et al. | |
| 10,055,019 | B2 | 8/2018 | Beran | |
| 10,255,777 | B1 | 4/2019 | Soto et al. | |
| 10,585,480 | B1 | 3/2020 | Bushnell et al. | |
| 2002/0003477 | A1 | 1/2002 | Roy, Jr. | |
| 2003/0178901 | A1 | 9/2003 | Erten et al. | |
| 2005/0093710 | A1 | 5/2005 | Soto et al. | |
| 2005/0190060 | A1 | 9/2005 | Clancy et al. | |
| 2007/0018832 | A1 | 1/2007 | Beigel et al. | |
| 2007/0080806 | A1 | 4/2007 | Lax et al. | |
| 2010/0097223 | A1 | 4/2010 | Kruest et al. | |
| 2010/0302199 | A1 | 12/2010 | Taylor et al. | |
| 2011/0227706 | A1 | 9/2011 | Yang | |
| 2012/0169134 | A1 | 7/2012 | Choudhary et al. | |
| 2013/0062962 | A1 | 3/2013 | Xue et al. | |
| 2013/0099696 | A1 | 4/2013 | Maxik et al. | |
| 2013/0194097 | A1 | 8/2013 | Joseph | |
| 2014/0070764 | A1 | 3/2014 | Keeling | |
| 2014/0085089 | A1 | 3/2014 | Rasband et al. | |
| 2014/0091932 | A1 | 4/2014 | Mohiuddin et al. | |
| 2014/0091933 | A1 | 4/2014 | Mohiuddin et al. | |
| 2014/0104047 | A1 | 4/2014 | Bolzmacher et al. | |
| 2014/0125471 | A1 | 5/2014 | Organ et al. | |
| 2014/0139637 | A1 | 5/2014 | Mistry et al. | |
| 2014/0159901 | A1 | 6/2014 | Copeland et al. | |
| 2014/0208559 | A1 * | 7/2014 | Stewart | E05B 73/0052 29/283 |
| 2014/0266629 | A1 | 9/2014 | Easter et al. | |
| 2014/0285145 | A1 | 9/2014 | Patro et al. | |
| 2015/0214748 | A1 | 7/2015 | Lin et al. | |
| 2015/0348727 | A1 | 12/2015 | Easter et al. | |
| 2016/0035197 | A1 | 2/2016 | Soto et al. | |
| 2016/0049058 | A1 | 2/2016 | Allen et al. | |
| 2016/0156228 | A1 | 6/2016 | Van Den Biggelaar et al. | |
| 2016/0260302 | A1 | 9/2016 | Ellers et al. | |
| 2016/0288807 | A1 * | 10/2016 | Huber, Jr. | B61H 13/34 |
| 2016/0342207 | A1 | 11/2016 | Beran | |
| 2016/0351034 | A1 | 12/2016 | Trivelpiece et al. | |
| 2016/0363997 | A1 | 12/2016 | Black et al. | |
| 2016/0364968 | A1 | 12/2016 | Sharpy et al. | |
| 2016/0364969 | A1 | 12/2016 | Casanova et al. | |
| 2017/0030109 | A1 | 2/2017 | Duncan et al. | |
| 2017/0040831 | A1 | 2/2017 | Desai et al. | |
| 2017/0140596 | A1 | 5/2017 | Retzlaff et al. | |
| 2017/0178479 | A1 * | 6/2017 | Ellers | G08B 13/242 |
| 2018/0097401 | A1 | 4/2018 | Gaskill et al. | |
| 2018/0219423 | A1 | 8/2018 | Maunder et al. | |
| 2018/0277292 | A1 | 9/2018 | Zarate et al. | |
| 2019/0027009 | A1 | 1/2019 | Miettinen et al. | |
| 2019/0038496 | A1 | 2/2019 | Levesque et al. | |
| 2019/0146585 | A1 | 5/2019 | Khalid et al. | |
| 2019/0201785 | A1 | 7/2019 | Heubel et al. | |
| 2020/0050913 | A1 | 2/2020 | Bergman et al. | |
| 2020/0211418 | A1 | 7/2020 | Greiner | |
| 2020/0305765 | A1 | 10/2020 | Herr et al. | |

* cited by examiner

TACK WITH FREE SPINNING FEATURE

CROSS-REFERENCE TO RELATED APPLICATIONS

The present application claims priority to U.S. Provisional Patent Application No. 62/903,470, which was filed on Sep. 20, 2019. The contents of which are incorporated herein by reference in its entirety.

FIELD

This document relates generally to pins or tacks. More particularly, this document relates to pins or tacks with a free spinning feature.

BACKGROUND

A typical Electronic Article Surveillance ("EAS") system in a retail setting may comprise a monitoring system and at least one security tag or marker attached to an article to be protected from unauthorized removal. The monitoring system establishes a surveillance zone in which the presence of security tags and/or markers can be detected. The surveillance zone is usually established at an access point for the controlled area (e.g., adjacent to a retail store entrance and/or exit). If an article enters the surveillance zone with an active security tag and/or marker, then an alarm may be triggered to indicate possible unauthorized removal thereof from the controlled area. In contrast, if an article is authorized for removal from the controlled area, then the security tag and/or marker thereof can be detached therefrom. Consequently, the article can be carried through the surveillance zone without being detected by the monitoring system and/or without triggering the alarm.

Radio Frequency Identification ("RFID") systems may also be used in a retail setting for inventory management and related security applications. In an RFID system, a reader transmits a Radio Frequency ("RF") carrier signal to an RFID device. The RFID device responds to the carrier signal with a data signal encoded with information stored by the RFID device. Increasingly, passive RFID labels are used in combination with EAS labels in retail applications.

As is known in the art, security tags for security and/or inventory systems can be constructed in any number of configurations. The desired configuration of the security tag is often dictated by the nature of the article to be protected. For example, EAS and/or RFID labels may be enclosed in a rigid tag housing, which can be secured to the monitored object (e.g., a piece of clothing in a retail store). The rigid housing typically includes a removable pin which is inserted through the fabric and secured in place on the opposite side by a securement mechanism (e.g., a clamp or ball clutch) disposed within the rigid housing. The pin is released from the securement mechanism by a detaching unit via application of a magnetic field by a magnet or mechanical probe inserted through an aperture in the hard tag. Examples of such detaching units are disclosed in U.S. Patent Publication No. 2014/0208559 ("the '559 patent application) and U.S. Pat. No. 7,391,327 ("the '327 patent").

SUMMARY

This document concerns systems and methods for operating a security tag. The methods comprise: transitioning a pin head from an extended position to a collapsed position by causing at least one first telescoping segment to slidingly engage a second telescoping segment; locking a shaft, extending out and away from the pin head in the collapsed position, using a securement mechanism disposed inside a housing of the security tag; and preventing a transfer of pin head rotation to the shaft at least when the shaft is locked by the securement mechanism.

In some scenarios, the methods also comprise: resiliently biasing the at least one first telescoping segment in a direction away from the second telescoping segment when the pin head in the extended position; and/or automatically transitioning the pin head from the collapsed position to the extended position when the shaft is released from the securement mechanism of the security tag. The automatic transitioning may be achieved using a resilient member disposed within the pin head. The resilient member may be disposed around the shaft.

The shaft may be entirely disposed within the pin head when the pin head is in the extended position. The pin head rotation may be prevented from being transferred to the shaft by: allowing the second telescoping segment to freely rotate relative to or around the at least one first telescoping segment; or allowing the pin head to rotate freely relative to the shaft. An interference fit may be provided between the shaft and the at least one first telescoping segment. The at least one first telescoping segment and the second telescoping segment may be created together during a single 3D printing process or session.

DESCRIPTION OF THE DRAWINGS

The present solution will be described with reference to the following drawing figures, in which like numerals represent like items throughout the figures.

DETAILED DESCRIPTION

Figure 1:
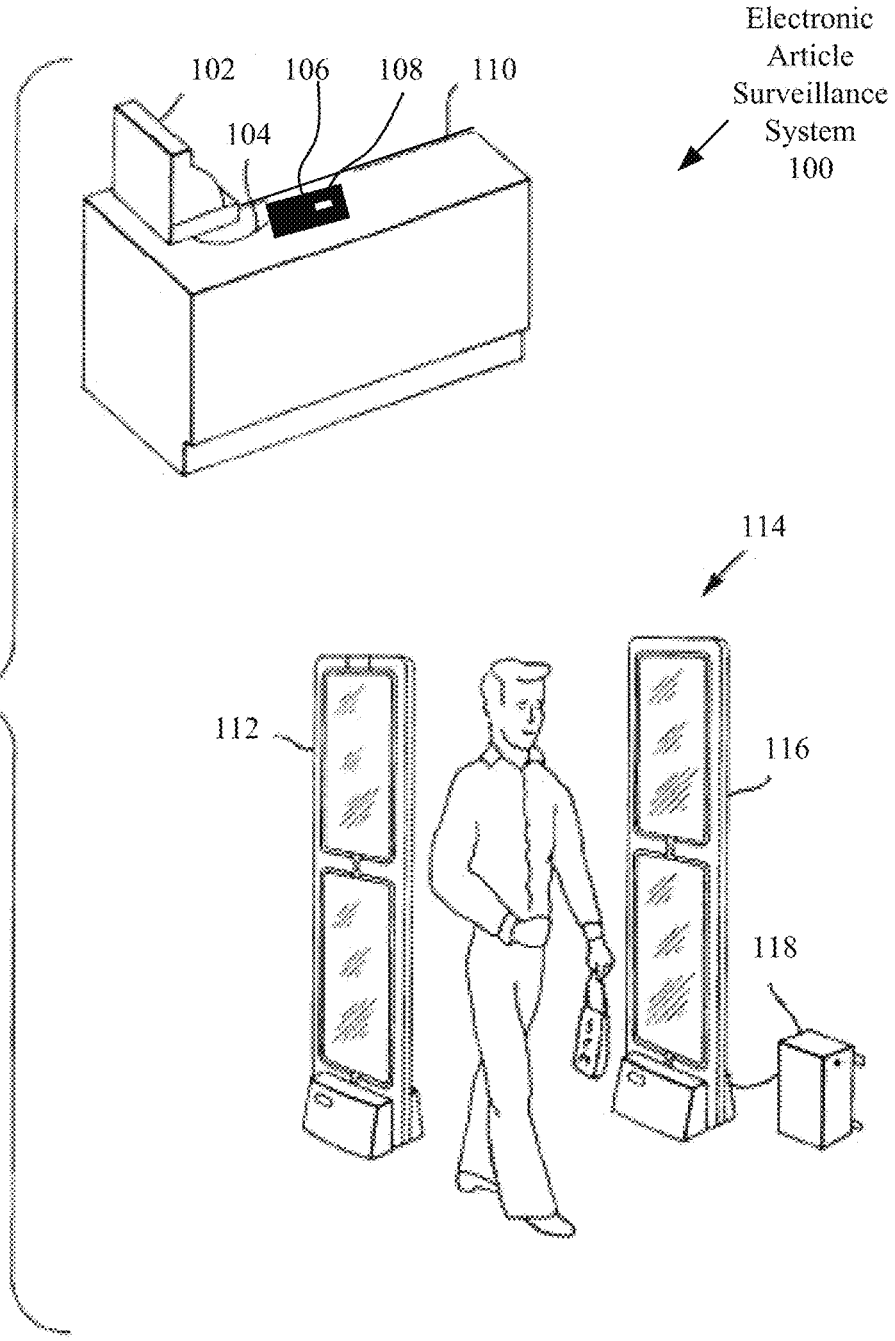
FIG. 1 provides an illustration of an illustrative architecture for an EAS system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

This disclosure broadly concerns tacks. The present solution is described herein in relation to security tag applications. The present solution is not limited in this regard. The present solution can be used in other applications where tacks are needed.

Traditional smooth pins used in ball clutch locks of hard tags can suffer from failures due to an applied pull force coupled with a rotation of the pin or tack shaft. The pin or tack shaft tends to work itself free from the ball clutch lock because of the smooth nature of the ball bearings and the pin/tack shaft.

Accordingly, the disclosure describes a form of a pin/tack with a free spinning protected design. The free spinning protected design provides added security to the traditional pins/tacks used with security tags.

The present pin/tack design has a self-ejecting version and a non-ejecting version. In the self-ejecting scenarios, the pin/tack comprises a pin head with a plurality of telescoping parts which are resiliently biased by a resilient member (e.g., a spring, compression pad (e.g., silicone pad), etc.) to an expanded position. The telescoping parts lend to the ability to securely shield a button/center tack shaft from access for defeat, and provide a free spinning bearing surface to prevent a rotational defeat of the ball clutch lock. In essence, in trying to create more torque on the center tack shaft via a pull force on an outer sleeve and friction between the parts, additional locking of the pin/tack is created through the pulling force due to the lack of interlocking features of the center tack shaft and outer sleeve. In this regard, it should be understood that the more the pin/tack is pulled away from the tag body, the harder the balls of the clutch dig into the pin/tack. However, since the outer sleeve of the pin head is free to rotate around the center assembly/pin, the axial force does not contribute to defeat but rather translates to more retention by the ball clutch. The more the pin/tack is pulled to try and rotate the center hub with friction, the more the ball clutch locks.

In the non-ejecting scenarios, the pin/tack includes a free spinning pin shaft within a pin head or a simple snap on outer ring creating the free spinning property of the assembly. For example, the pin head would be absent of any telescoping elements, but would have at least a first part securely coupled to the pin/tack and a second part rotatably coupled to the first part. The pin head could look similar to the telescoping pin head in its collapsed state. The present solution is not limited to the particulars of this example. All that is needed to implement the present solution is a pin head that is designed to allow at least a part of the pin head to rotate relative to the pin/tack. Various designs are conceivable for achieving this rotatable configuration.

The free spinning pin/tack of the present solution will be described herein in relation to EAS applications. The present solution is not limited in this regard. The free spinning pin/tack can be used in any other application where a tack is used in conjunction with a lock mechanism.

Referring now to FIG. 1, there is provided an illustration of an illustrative EAS system 100. EAS systems are well known in the art, and therefore will not be described in detail herein. Still, it should be understood that the present solution will be described herein in relation to an acousto-magnetic (or magnetostrictive) EAS system. The present solution is not limited in this regard. The EAS system 100 may alternatively include a magnetic EAS system, an RF EAS system, a microwave EAS system or other type of EAS system. In all cases, the EAS system 100 generally prevents the unauthorized removal of articles from a retail store.

In this regard, security tags 108 are securely coupled to articles (e.g., clothing, toys, and other merchandise) offered for sale by a retail store. Illustrative architectures of the security tags 108 will be described below in relation to FIGS. 3-12. At the exits of the retail store, detection equipment 114 sounds an alarm or otherwise alerts store employees when it senses an active security tag 108 in proximity thereto. Such an alarm or alert provides notification to store employees of an attempt to remove an article from the retail store without proper authorization.

In some scenarios, the detection equipment 114 comprises antenna pedestals 112, 116 and an electronic unit 118. The antenna pedestals 112, 116 are configured to create a surveillance zone at the exit or checkout lane of the retail store by transmitting an EAS interrogation signal. The EAS interrogation signal causes an active security tag 108 to produce a detectable response if an attempt is made to remove the article from the retail store. For example, the security tag 108 can cause perturbations in the interrogation signal, as will be described in detail below.

The antenna pedestals 112, 116 may also be configured to act as RFID readers. In these scenarios, the antenna pedestals 112, 116 transmit an RFID interrogation signal for purposes of obtaining RFID data from the active security tag 108. The RFID data can include, but is not limited to, a unique identifier for the active security tag 108. In other scenarios, these RFID functions are provided by devices separate and apart from the antenna pedestals.

The security tag 108 can be deactivated and detached from the article using a detaching unit 106. Typically, the security tag 108 is removed or detached from the articles by store employees when the corresponding article has been purchased or has been otherwise authorized for removal from the retail store. The detaching unit 106 is located at a checkout counter 110 of the retail store and communicatively coupled to a POS terminal 102 via a wired link 104. In general, the POS terminal 102 facilitates the purchase of articles from the retail store.

Detaching units and POS terminals are well known in the art, and therefore will not be described herein. Detaching unit 106 can include any known or to be known detaching unit. Similarly, the POS terminal 102 can include any known or to be known POS terminal.

In some cases, the detaching unit 106 is configured to operate as an RFID reader. As such, the detaching unit 106 may transmit an RFID interrogation signal for purposes of obtaining RFID data from a security tag 108. Upon receipt of the tag's unique identifier and/or an article's identifier, the detaching unit 106 communicates the same to the POS terminal 102. At the POS terminal 102, a determination is made as to whether the received identifier(s) is(are) valid for a security tag of the retail store. If it is determined that the received identifier(s) is(are) valid for a security tag of the retail store, then the POS terminal 102 notifies the detaching unit 106 that the same has been validated, and therefore the security tag 108 can be removed from the article.

At this time, the detaching unit 106 performs operations to cause an internal coil to generate a magnetic field. This magnetic field causes actuation of a lock mechanism (e.g., a 3-ball clutch) disposed inside the security tag 108. This lock actuation results in a release of a pin or tack from the lock mechanism.

Notably, the present solution is not limited to the use of a magnetic field to cause actuation of the lock mechanism. Other techniques that are known or to be known can be employed here.

Figure 2:
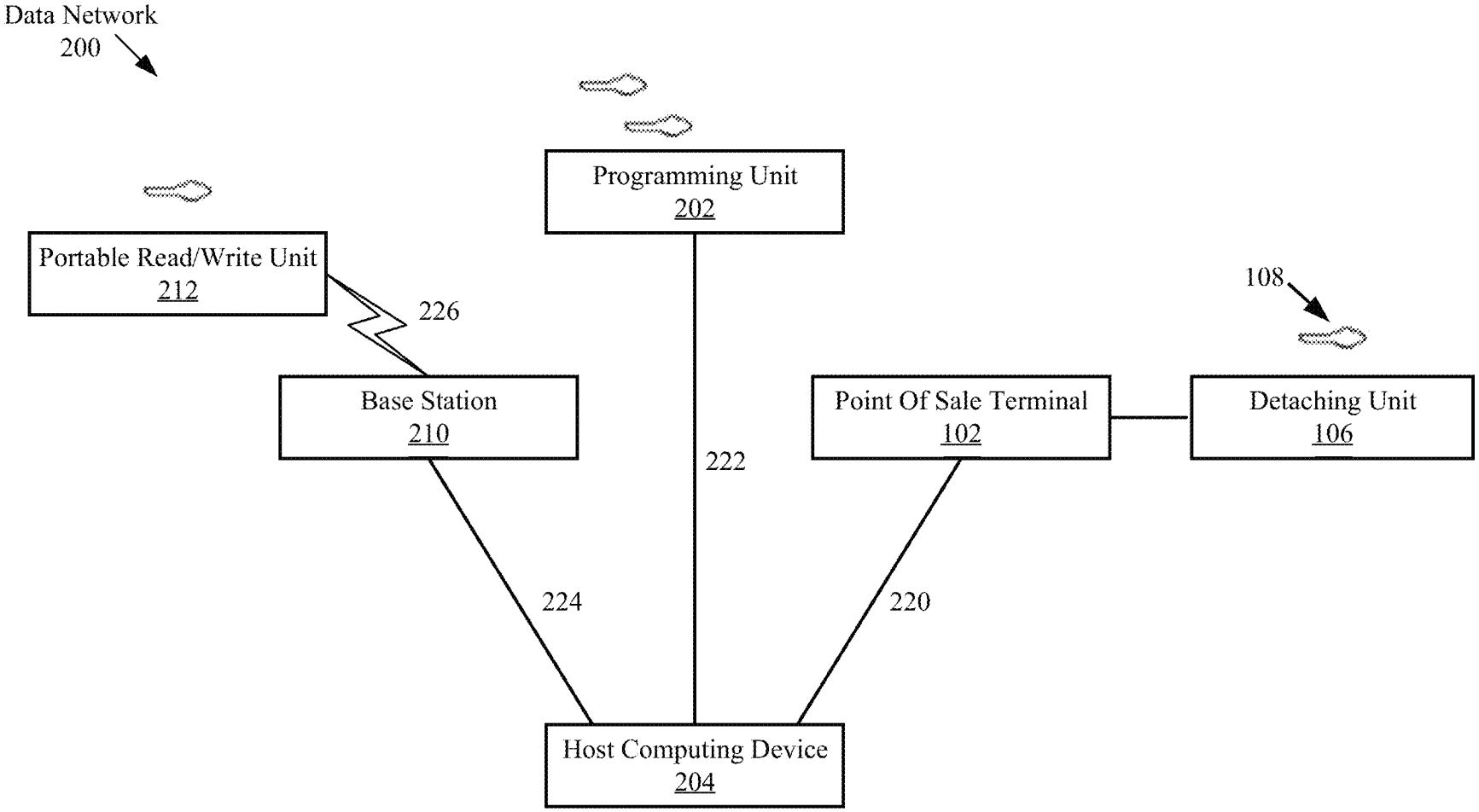
FIG. 2 provides an illustration of an illustrative architecture for a data network.

Referring now to FIG. 2, there is provided an illustration of an illustrative architecture for a data network 200 in which the various components of the EAS system 100 are coupled together. Data network 200 comprises a host computing device 204 which stores data concerning at least one of merchandise identification, inventory, and pricing. A first data signal path 220 allows for two-way data communication between the host computing device 204 and the POS terminal 102. A second data signal path 222 permits data communication between the host computing device 204 and a programming unit 202. The programming unit 202 is generally configured to write product identifying data and other information into memory of the security tag 108. A third data signal path 224 permits data communication between the host computing device 204 and a base station 210. The base station 210 is in wireless communication with a portable read/write unit 212. The portable read/write unit 212 reads data from the security tags for purposes of determining the inventory of the retail store, as well as writes data to the security tags. Data can be written to the security tags when they are applied to articles of merchandise.

Figure 3:
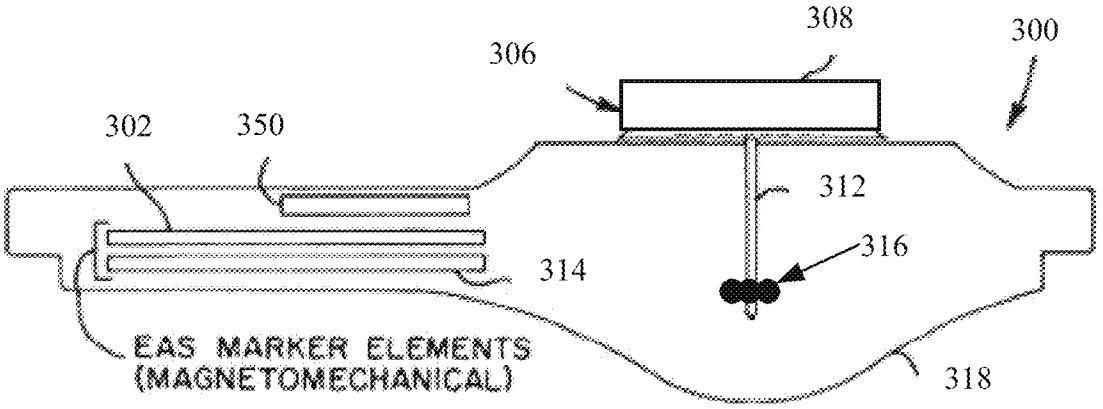
FIG. 3 provides a cross sectional view of an illustrative architecture for a security tag.

Referring now to FIG. 3, there is provided a cross sectional view of an illustrative architecture for a security tag 300. Security tag 108 can be the same as or similar the security tag 300. As such, the discussion of security tag 300 is sufficient to understand security tag 108 of FIGS. 1-2.

As shown in FIG. 3, security tag 300 comprises a housing 318 which is at least partially hollow. The housing 318 can be formed from a rigid or semi-rigid material, such as plastic. A pin (or tack) 306 is removably coupled to the housing 318. The pin 306 comprises a pin head 308 and a shaft 312. The shaft 312 is inserted into a recessed hole formed in the housing 318. The shaft 312 is held in position within the recessed hole via a lock mechanism 316, which is mounted inside the housing 318. Lock mechanisms are well known in the art, and therefore will not be described in detail herein. Any known or to be known lock mechanism can be used herein without limitation. In some scenarios, the lock mechanism 316 includes a 3-ball clutch, clamp, latch or other coupler that is actuated by an application of magnetic field to the security tag 300. The present solution is not limited in this regard.

A magnetostrictive active EAS element 314 and a bias magnet 302 are optionally also disposed within the housing 318. These components 314, 302 may be the same as or similar to that disclosed in U.S. Pat. No. 4,510,489. In some scenarios, the resonant frequency of components 314, 302 is the same as the frequency at which the EAS system (e.g., EAS system 100 of FIG. 1) operates (e.g., 58 kHz). Additionally, the EAS element 314 is formed from thin, ribbon-shaped strips of substantially completely amorphous metal-metalloid alloy. The bias magnet 302 is formed from a rigid or semi-rigid ferromagnetic material. Embodiments are not limited to the particulars of these scenarios.

During operation, antenna pedestals (e.g., antenna pedestals 112, 116 of FIG. 1) of an EAS system (e.g., EAS system 100 of FIG. 1) emit periodic tonal bursts at a particular frequency (e.g., 58 kHz) that is the same as the resonance frequency of the amorphous strips (i.e., the EAS interrogation signal). This causes the strips to vibrate longitudinally by magnetostriction, and to continue to oscillate after the burst is over. The vibration causes a change in magnetism in the amorphous strips, which induces an AC voltage in an antenna structure (not shown in FIG. 3). The antenna structure (not shown in FIG. 3) converts the AC voltage into a radio wave. If the radio wave meets the required parameters (correct frequency, repetition, etc.), the alarm is activated.

An electronic circuit 350 is also provided within the housing 318. The electronic circuit 350 is generally configured to facilitate communications between the security tag 300 and external devices, as well as a release of the shaft 312 from the lock mechanism 316.

Figure 4:
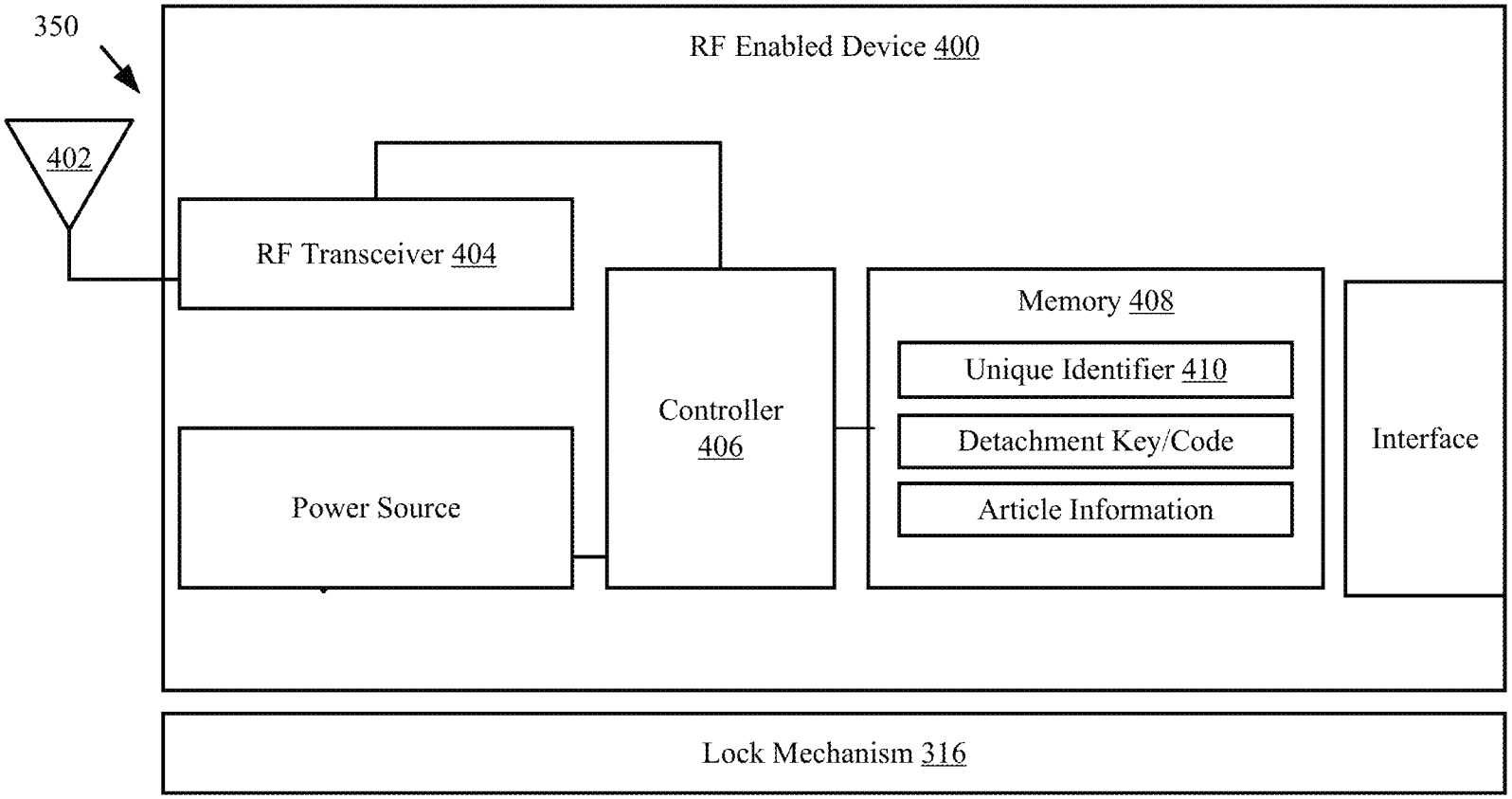
FIG. 4 provides a block diagram of an illustrative hardware architecture for the electronic circuit of the security tag show in FIG. 3.

Referring now to FIG. 4, there is provided an illustration of an illustrative architecture for the security tag's electronic circuit 350. Electronic circuit 350 can include more or less components than that shown in FIG. 4. However, the components shown are sufficient to disclose an illustrative embodiment implementing the present solution. Some or all of the components of the electronic circuit 350 can be implemented in hardware, software and/or a combination of hardware and software. The hardware includes, but is not limited to, one or more electronic circuits. The hardware architecture of FIG. 4 represents a representative electronic circuit 350 of a security tag configured to facilitate the prevention of an unauthorized removal of an article from a retail store facility.

The electronic circuit 350 comprises an antenna 402 and an RF enabled device 400. The RF enabled device 400 allows data to be exchanged with the external device (e.g., POS terminal 102 of FIG. 1 or pedestals 112, 116 of FIG. 1) via RF technology. The antenna 202 is configured to receive RF signals from the external device and transmit RF signals generated by the RF enabled device 400. The RF enabled device 400 comprises an RF transceiver 404. RF transceivers are well known in the art, and therefore will not be described herein. Any known or to be known RF transceiver can be used here.

During a detachment process, the RF transceiver 404 receives an RF signal from the detaching unit 106. The controller 406 processes the received RF signal to extract information therein. This information can include, but is not limited to, a request for certain information (e.g., a unique identifier 410). If the extracted information includes a request for certain information, then the controller 406 may perform operations to retrieve a unique identifier 410 from memory 408. The retrieved information is then sent from the security tag 108 to the detaching unit 106 via an RF communication facilitated by the RF transceiver 404.

The detaching unit 106 may also generate a magnetic field. This magnetic field causes an actuation of the lock mechanism 316. This actuation results in the movement of the lock mechanism between a lock state (or engaged state) to an unlock (or disengaged) state. A pin shaft is released from the lock mechanism 316 when the lock mechanism transitions to its unlock (or disengaged) state. At this time, the pin or tack can be removed from the security tag and/or article of clothing.

Memory 408 may be a volatile memory and/or a non-volatile memory. For example, the memory 408 can include, but is not limited to, a Random Access Memory ("RAM"), a Dynamic Random Access Memory ("DRAM"), a Static Random Access Memory ("SRAM"), a Read-Only Memory ("ROM") and a flash memory. The memory 408 may also comprise unsecure memory and/or secure memory. The phrase "unsecure memory", as used herein, refers to memory configured to store data in a plain text form. The phrase "secure memory", as used herein, refers to memory configured to store data in an encrypted form and/or memory having or being disposed in a secure or tamper-proof enclosure.

Referring now to FIGS. 5-11, there are provided illustrations of an illustrative architecture for the pin 306. As shown in FIGS. 5-11, pin 306 comprises a pin head 308 and a shaft 312 securely coupled to the pin head 308. The pin 306 is self-ejecting meaning that the shaft 312 is automatically removed from a security tag's housing (e.g., housing 318 of FIG. 3) when the shaft 312 is released from the security tag's lock mechanism (e.g., lock mechanism 316 of FIGS. 3-4). The self-ejecting feature of the pin 306 can be achieved using a resilient member resiliently biasing the pin head 308 is a direction away from the security tag's housing. The resilient member can include, but is not limited to, a spring, a metal or plastic beam, or other means of lifting the pin/tack free of the lock mechanism when the lock mechanism is disengaged. In the spring scenario, the resilient member is normally in an uncompressed state, and is transitioned to a compressed state when the pin head 308 is depressed. This self-ejecting feature of the pin 306 is facilitated by the specially designed pin head 308. Also, as mentioned above, a non-ejecting pin/tack can be designed in a similar fashion.

The pin head 308 comprises a plurality of telescoping segments 502, 504, 506 and a resilient element 508. The telescoping segments 502, 504, 506 and resilient element 508 are vertically aligned with each other, i.e., they have the same center axis 1100. The telescoping segments 502-506 are each formed of a rigid material or semi-rigid material. Such materials include, but are not limited to, metal and plastic. The resilient element 508 includes, but is not limited to, a spring or other compressible element (e.g., rubber, foam, metal beam, etc.).

It should be mentioned that another version of the pin/tack design includes a portion of the outer sleeve coupled to the tag body to in essence create a one-piece design. The pin/tack still ejects. However, the pin/tack is captivated by the outer sleeve (or in that context a connected tag housing) to maintain coupling to the tag body. This deviates from the above-described solution since the free-rotation aspect of the pin/tack (the outer sleeve) has now been fixed to the security tag's housing.

Although three telescoping segments are shown in FIGS. 5-11, the present solution is not limited in this regard. The pin head 308 can have any number of telescoping segments selected in accordance with a particular application. The telescoping segments can have the same or different lengths 1000, 1002, 1004.

Figure 7:
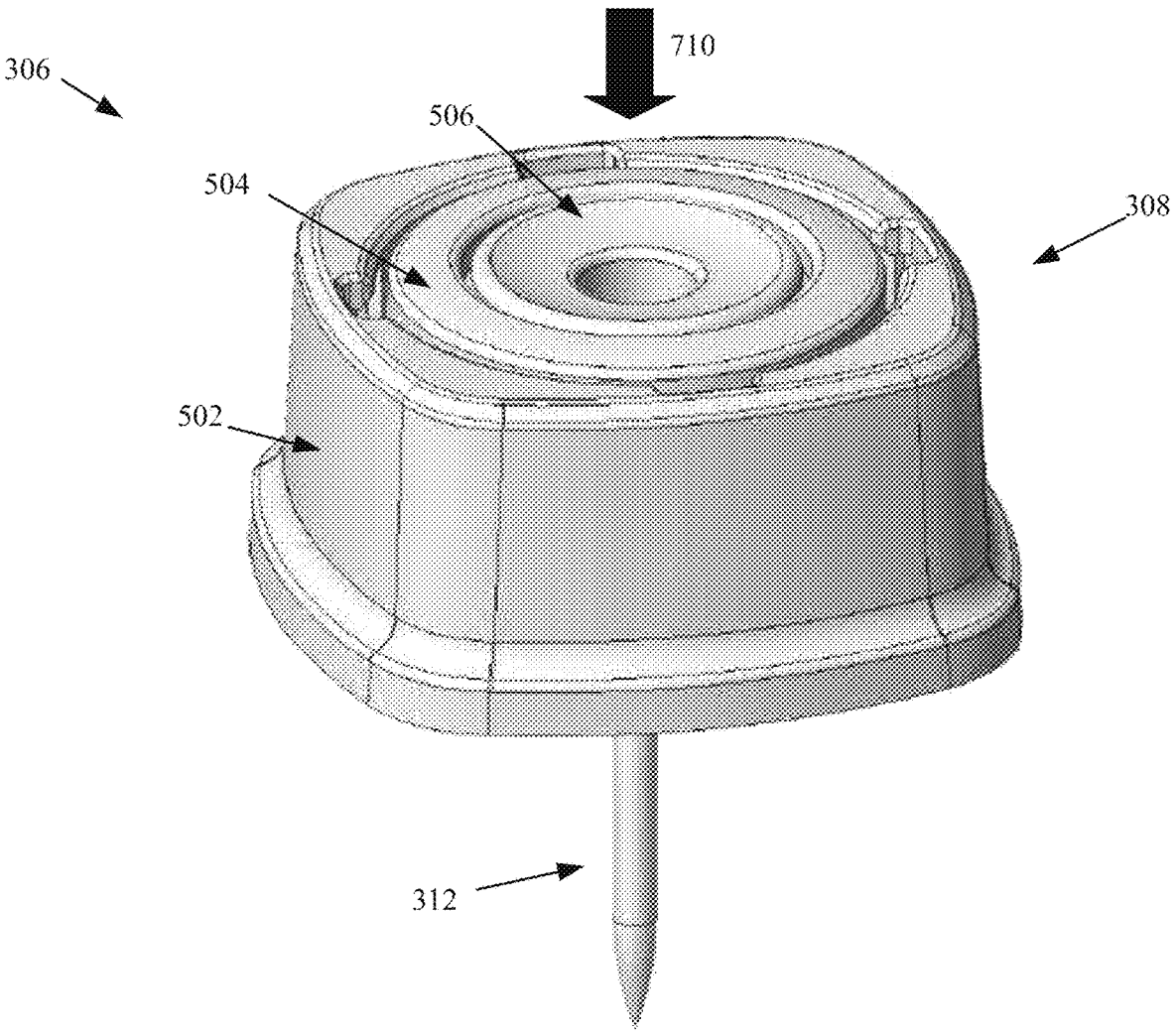
FIG. 7 provides a perspective view of the pin in a collapsed position.
Figure 8:
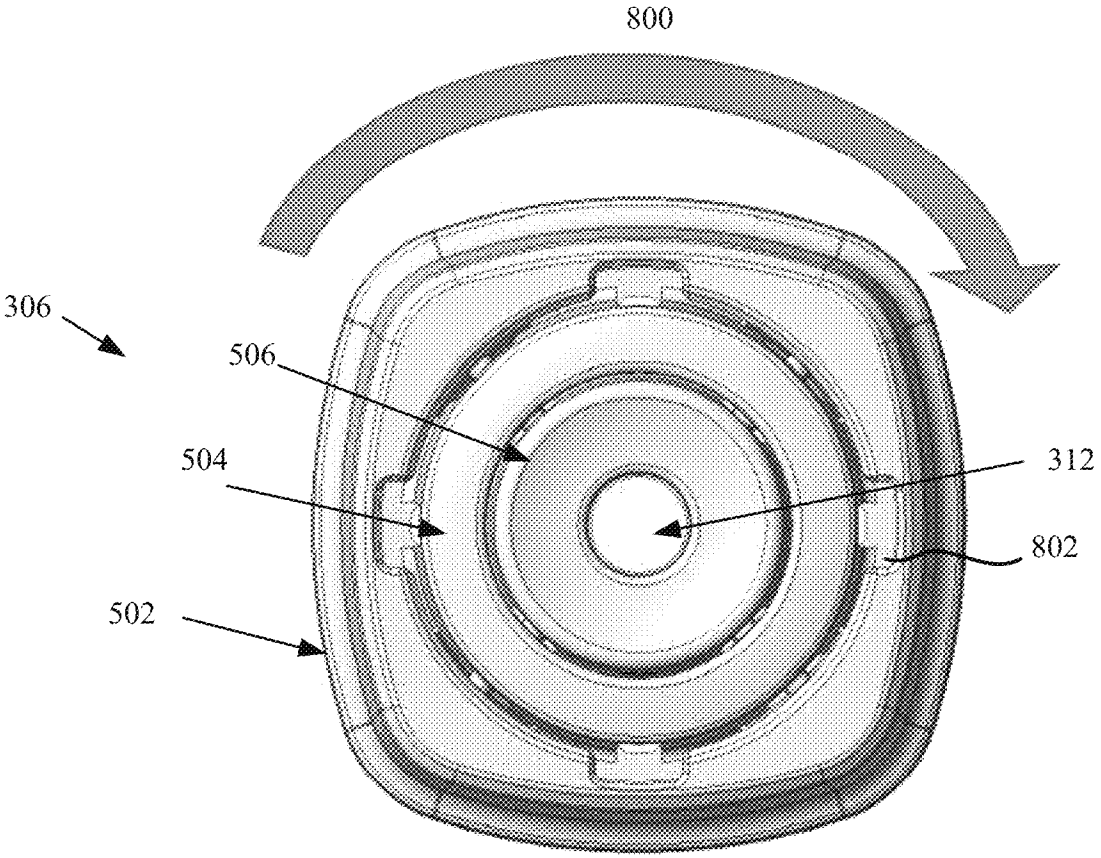
FIG. 8 provides a top view of the pin in the collapsed position.
Figure 11:
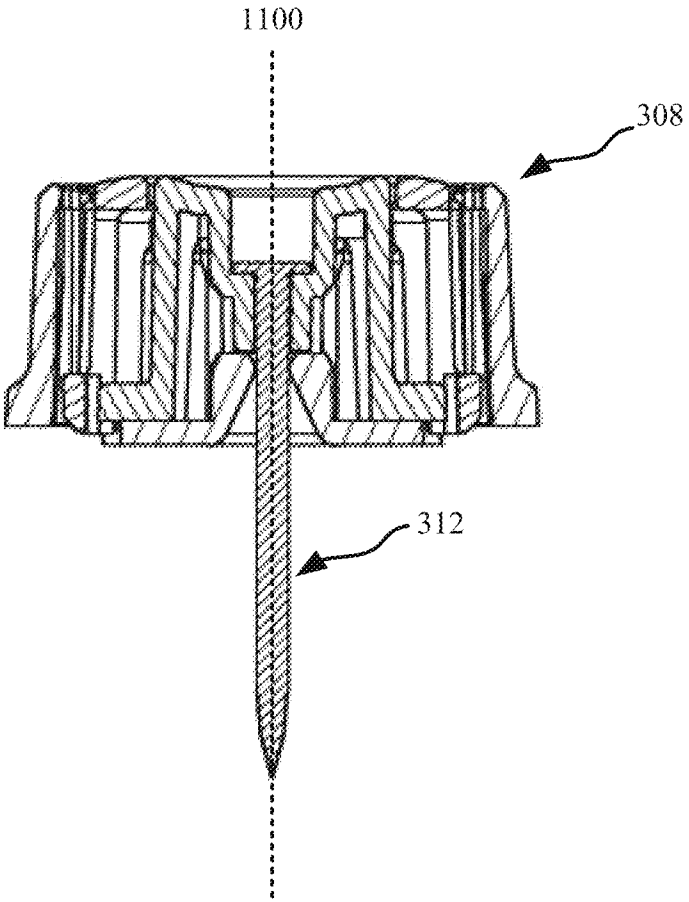
FIG. 11 provides a cross-sectional view of the pin in the collapsed position.

The telescoping segments 502, 504, 506 have a stacked arrangement when the pin head 308 is in a collapsed position shown in FIGS. 7 and 11. The telescoping segment 502 is the outer most telescoping segment. The outer most telescoping segment 502 does not move vertically relative to the other telescoping segments 504, 506. The telescoping segment 506 is the inner most telescoping segment with the smallest diameter 1010 of all the telescoping segments 502-506. The diameter 1010 of the telescoping segment 506 is slightly smaller than the diameter 1008 of the middle telescoping segment 504 such that: the inner most telescoping segment 506 can slide within the middle telescoping segment 504 in direction shown by arrow 710 until it collapses into the middle telescoping segment 504; and the inner most telescoping segment 506 can slide within the middle telescoping segment 504 in direction shown by arrow 510 until it extends out from the middle telescoping segment 504. Similarly, the diameter 1008 of the middle telescoping segment 504 is slightly smaller than the diameter 1006 of the outer most telescoping segment 502 such that: the middle telescoping segment 504 can slide within the outer most telescoping segment 502 in direction shown by arrow 710 until it collapses into the outer most telescoping segment 502; and the middle telescoping segment 504 can slide within the outer most telescoping segment 502 in direction shown by arrow 510 until it extends out from the outer most telescoping segment 502.

The three telescoping segments 502, 504, 506 are coupled to each other such that the inner most telescoping segment 506 is unable to be decoupled from the middle telescoping segment 504, and the middle telescoping segment 504 is unable to be decoupled from the outer most telescoping segment 502. In this regard, it should be understood that the inner most telescoping segment 506 comprises at least one flange 902 at a bottom end 904 thereof that engages a top inner surface 906 of the middle telescoping segment 504 so as to prevent the inner most telescoping segment 506 from being pulled out of or otherwise traveling out of the middle telescoping segment 504. Similarly, the middle telescoping segment 504 comprises at least one flange 908 at a bottom end 910 thereof that engages a top inner surface 912 of the outer most telescoping segment 502 so as to prevent the middle telescoping segment 504 from being pulled out of or otherwise traveling out of the outer most telescoping segment 502.

Figure 5:
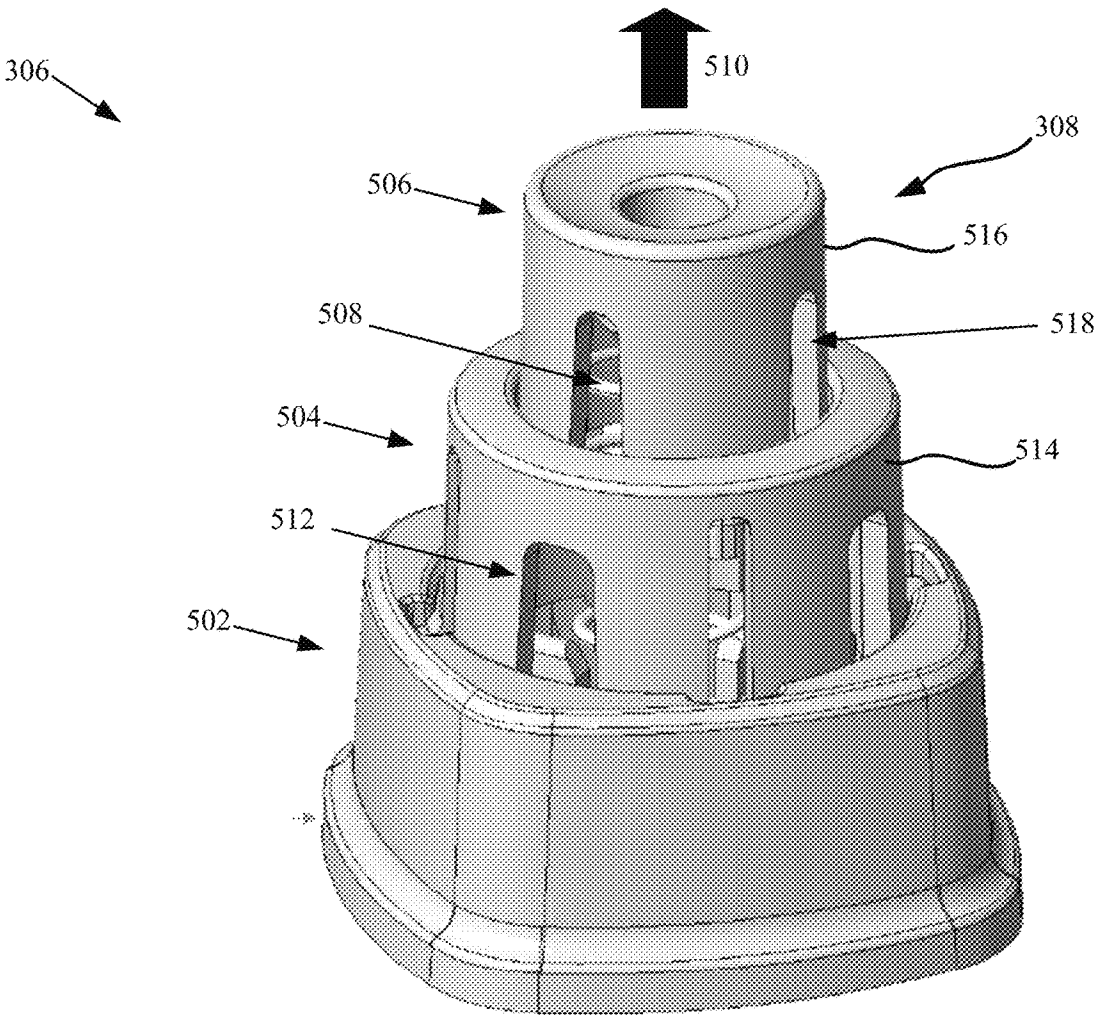
FIG. 5 provides a perspective view of an illustrative pin in an extended position.
Figure 6:
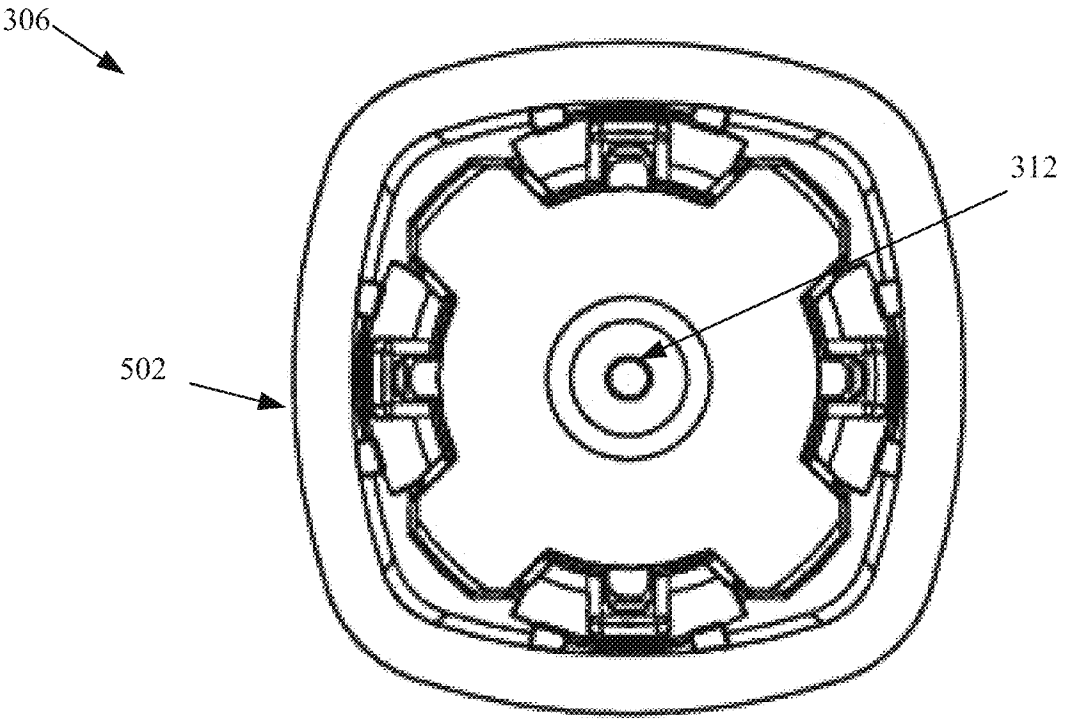
FIG. 6 provides a bottom view of the pin shown in FIG. 5.
Figure 9:
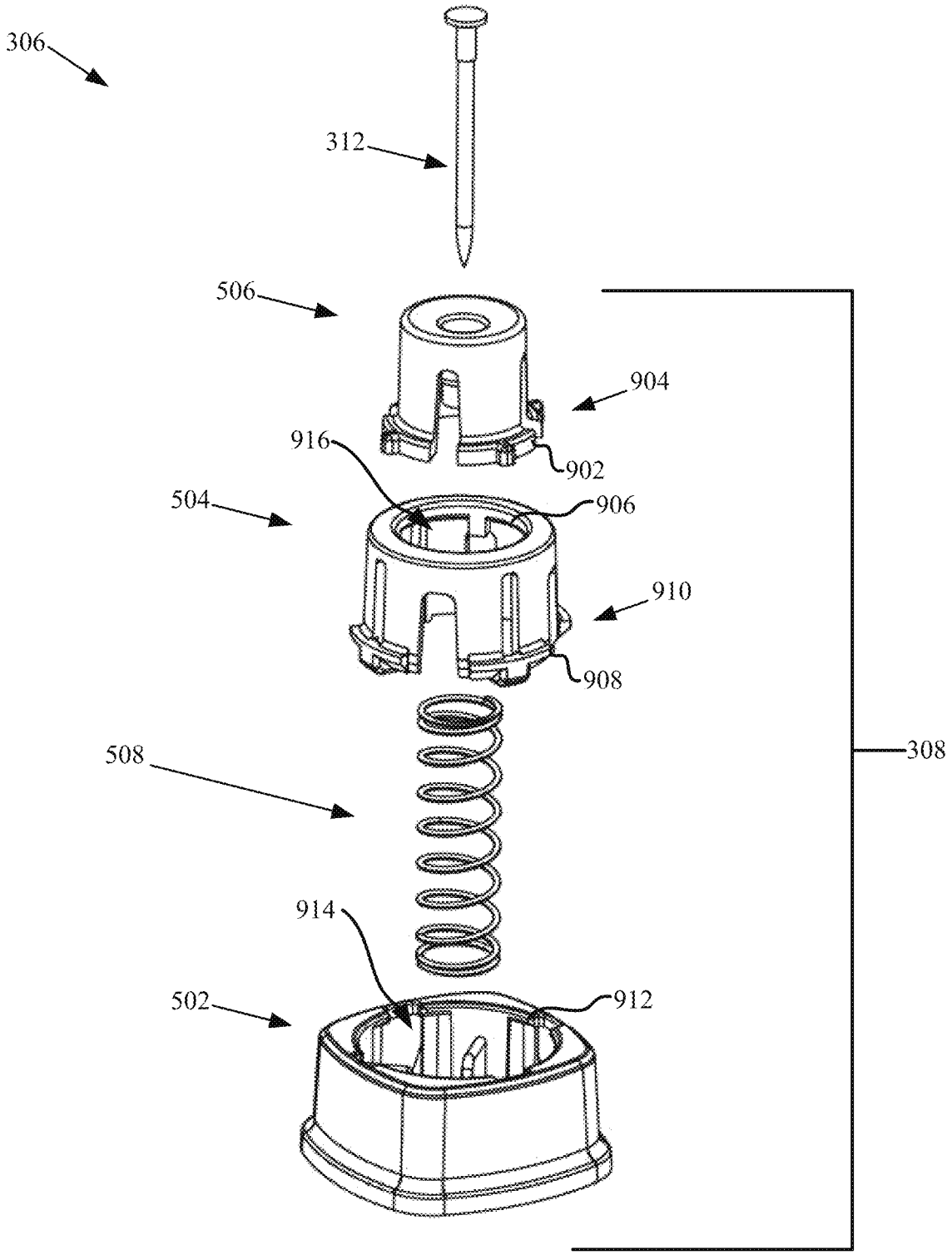
FIG. 9 provides an exploded view of the pin shown in FIGS. 5-9.
Figure 10:
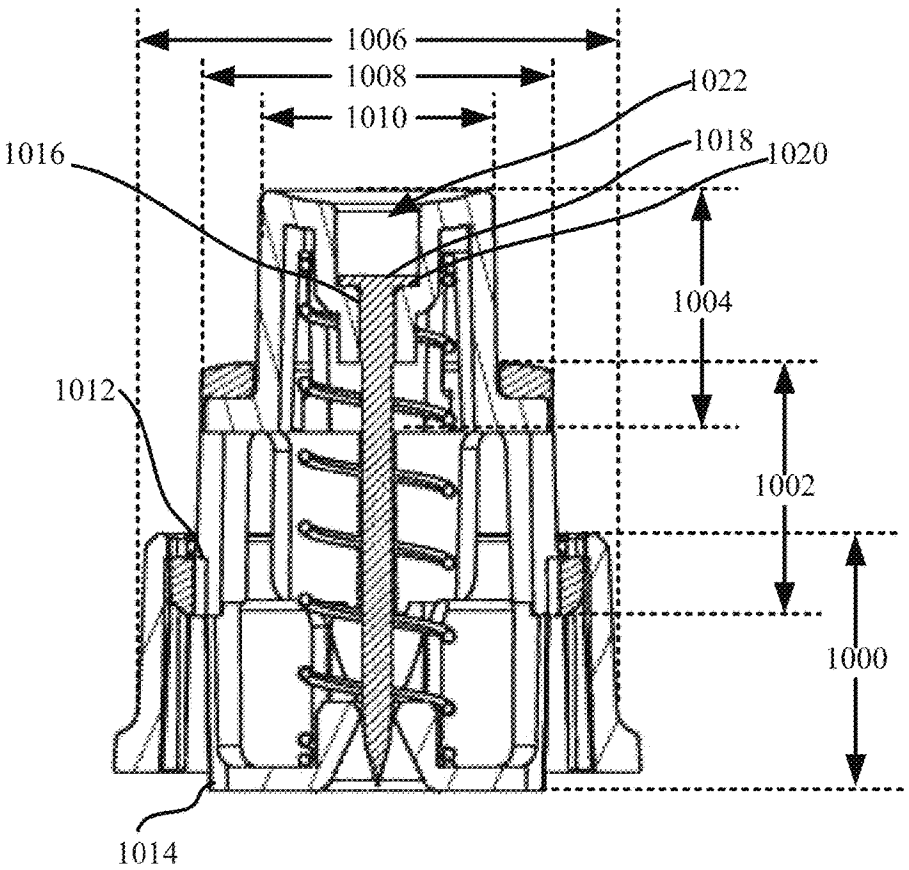
FIG. 10 provides a cross-sectional view of the pin in the extended position.

The resilient element 508 is normally in an uncompressed state shown in FIGS. 5, 9 and 10. When in the uncompressed state, the resilient element 508 applies an upward pushing force on the inner most telescoping segment 506. In effect, the resilient element 508 provides a means to automatically transition the pin head 308 from the compressed state shown in FIGS. 7 and 11 to the uncompressed state shown in FIGS. 5, 9 and 10 when the shaft 312 is released from the security tag's lock mechanism (e.g., a 3-ball clutch). When the resilient element 508 is in its compressed state, the telescoping segments 502-506 are in their collapsed positions shown in FIGS. 7 and 11. In the collapsed positions, the telescoping segments 502-506 have a stacked arrangement. In contrast, when the resilient element 508 is in its uncompressed state, the telescoping segments 502-506 are in their extended positions shown in FIGS. 5 and 10.

During a transition from the collapsed positions to the extended positions, the resilient element 508 applies a pushing force on the inner most telescoping segment 506. Consequently, the inner most telescoping segment 506 slides in the middle telescoping segment 504 in direction 510. Once the inner most telescoping segment 506 reaches its extended position, the flange 902 of the inner telescoping segment 506 engages the top inner surface 906 of the middle telescoping segment 504. This engagement causes the middle telescoping segment 504 to slide in the outer most telescoping segment 502 in direction 510 until it reaches its extended position.

During a transition from the extended positions to the collapsed positions, a downward pushing force is applied to the inner most telescoping segment 506 (e.g., by an individual). Consequently, the resilient element 508 is compressed and the inner most telescoping segment 506 slides in the middle telescoping segment 504 in direction 710. The inner most telescoping segment 506 slidingly engages the middle telescoping segment 504 until the flange 902 of the inner most telescoping segment 506 engages a stop structure 1012 provided on an inner surface of the middle telescoping segment 504.

Once the flange 902 contacts the stop structure 1012, a downward force is also applied to the middle telescoping segment 504. In effect, the inner most telescoping segment 506 and middle telescoping segment 504 travel in direction 710 together. More particularly, the telescoping segments 504, 506 slide within the outer most telescoping segment 502 until a flange 908 of the middle telescoping segment 504 engages a stop structure or bottom wall 1014 of the outer most telescoping segment 502.

The telescoping segments 502-506 are retained in their collapsed positions using the shaft 312. For example, the shaft 312 is locked by a lock mechanism (e.g., lock mechanism 316 of FIG. 3) of a security tag so as to retain the pin head 308 in the collapsed position shown in FIG. 7. The present solution is not limited in this regard.

In this regard, it should be understood that the shaft 312 is securely coupled to the inner most telescoping segment 506. As shown in FIG. 10, the shaft 312 extends through an aperture 1016 formed in the inner most telescoping segment 506. The aperture 1016 is sized and shaped so that an interference fit and/or a frictional engagement is created between the shaft 312 and the inner most telescoping segment 506. A flange 1018 is provided at the top end of the shaft 312. The flange 1018 engages a bottom wall 1020 of a cavity 1022 formed in the inner most telescoping segment 506 so as to ensure that the shaft 312 cannot be pushed or pulled all the way through the aperture 1016 of the inner most telescoping segment 506. Notably, an interference fit and/or a frictional engagement may also be created between the flange 1018 and the inner most telescoping segment 506. The shaft 312 is vertically aligned with the pin head 308, i.e., the shaft 312 and pin head 308 have the same center axis 1100. An adhesive or other coupling means may also be used in addition to or as an alternative to the interference fit(s) and/or a frictional engagement(s) between the pin 306 and the inner most telescoping segment 506.

As noted above, the security tag's lock mechanism can fail when a smooth pin shaft is simultaneously rotated and pulled away from the security tag's housing. The present solution incorporates a solution to this issue. More particularly, the pin head 308 is designed so as to eliminate one's ability to simultaneously rotate and pull the pin shaft 312 from the security tag's housing 318. In effect, a smooth pin can be used with the present pin head 308 without causing failure of the security tag's lock mechanism as a result of simultaneously rotating and pulling away the pin 306 from the security tag's housing. Notched pins can also be used with the present solution (i.e., a pin with a shaft having one or more notches formed along an elongate length thereof).

In this regard, it should be understood that at least one of the telescoping segments 502, 504 is rotatable relative to the inner most telescoping segment 506. Thus, when the pin head 308 is in its collapsed state shown in FIGS. 7 and 11, a pulling force may be applied to the shaft 312 via the telescoping segments 502-506. However, the shaft 312 is unable to be rotated at the same time since a rotating force 800 applied to outer most telescoping segment 502 of the pin head 308 causes at least the outer most telescoping segment 502 to rotate about the inner most telescoping segment 506. In effect, the rotating force is not transferred to the shaft 312 via the telescoping segment 506.

Notably, the pin 306 is designed so that the shaft 312 resides entirely within the pin head 308 when the pin head 308 is in its extended position shown in FIGS. 5 and 10. This arrangement ensures that users are not hurt by the shaft 312 when the pin 306 is removed from the security tag. A mechanism may be provided to selectively retain the pin 306 in the pin head 308 until a desired time (e.g., when the pin 306 is to be used to secure a tag to an article (e.g., a piece of clothing)). This mechanism can include, but is not limited to, a depressible post provided with one or more of the telescoping segments 502-506 (e.g., a post that is depressed when the pin head 308 is to be transitioned from its extend position to its collapsed position, and undepressed so as to extend out and away from the telescoping segments and prevent sliding engagement between the telescoping segments 502-506 when the pin head 308 is in its extended position). The present solution is not limited in this regard. In some scenarios, it may alternatively be desirable for at least a portion of the shaft 312 to extend out from the pin head 308 when the pin head 308 is in its extended position. An illustration showing this arrangement is provided in FIG. 12.

Figure 12:
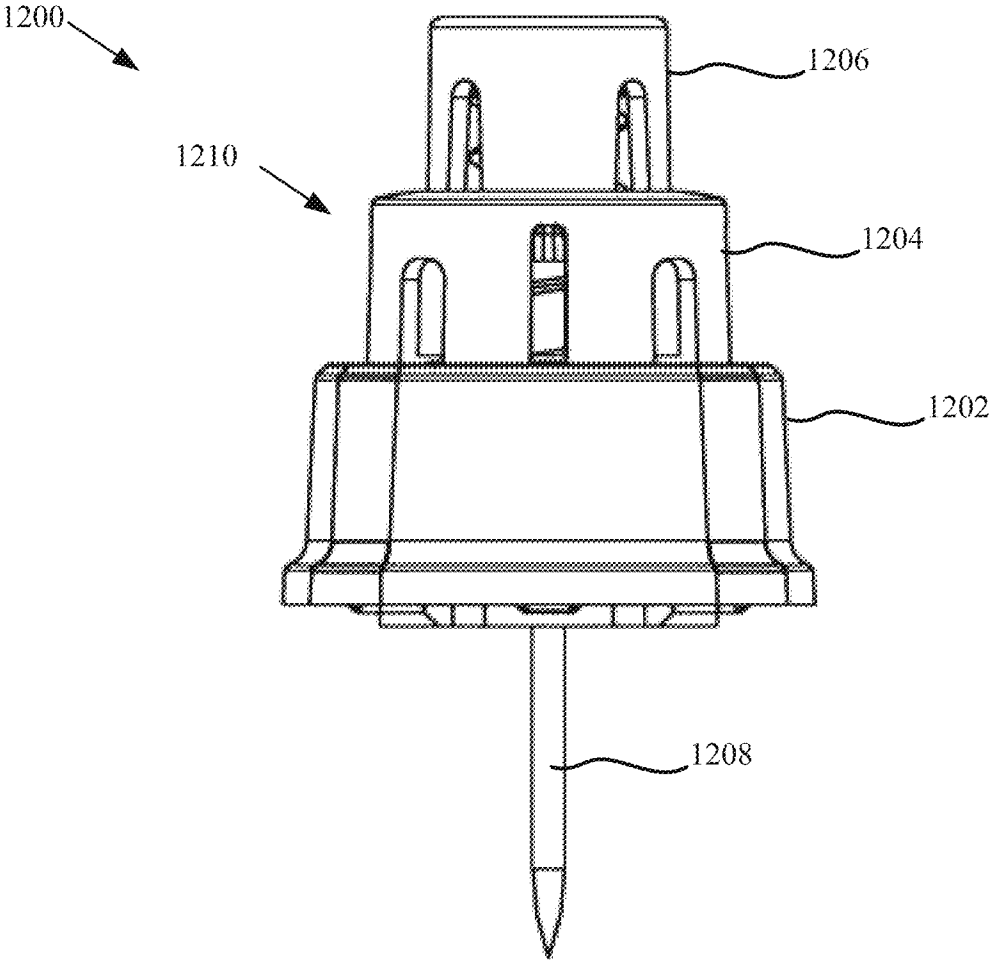
FIG. 12 provides a side view of another illustrative pin.

Notably, the free spinning feature of pin 1200 shown in FIG. 12 is different than the free spinning feature of pin 306. In this regard, it should be understood that the telescoping segment(s) 502, 504 of pin 306 can freely spin relative to or around the inner most telescoping segment 506. In contrast, the telescoping segments 1202, 1204, 1206 are arranged so that they can freely spin relative to or around the pin 1200 and/or pin shaft 1208 (or stated differently, the shaft 1208 can spin relative to the pin head 1210).

In some scenarios, the pin 306 is provided with visual elements that assist a user with knowing where the center of the shaft 312 is located relative to the pin head 308. These visual elements can include, but are not limited to, notches 802 or marks (not shown) formed in or on one or more of the telescoping segments 502-506. Although four visual elements are shown in FIGS. 5-11, the present solution is not limited in this regard. Any number of visual elements can be used in accordance with a given application.

As should be evident from the above discussion, a subtle design element that lends to higher level security is 2-fold: (1) when the pin/tack is fully depressed the pin is not accessible from the top in any way due to the stacked height of the inner most button/sleeve and (2) the inner most sleeve is concave to maintain its position sub-surface to the adjacent sleeve and provide usability for finding the center of the pin/tack. This does not allow someone trying to pull the center pin/tack to be able to gain access to any feature of the center button from the top.

Figure 13:
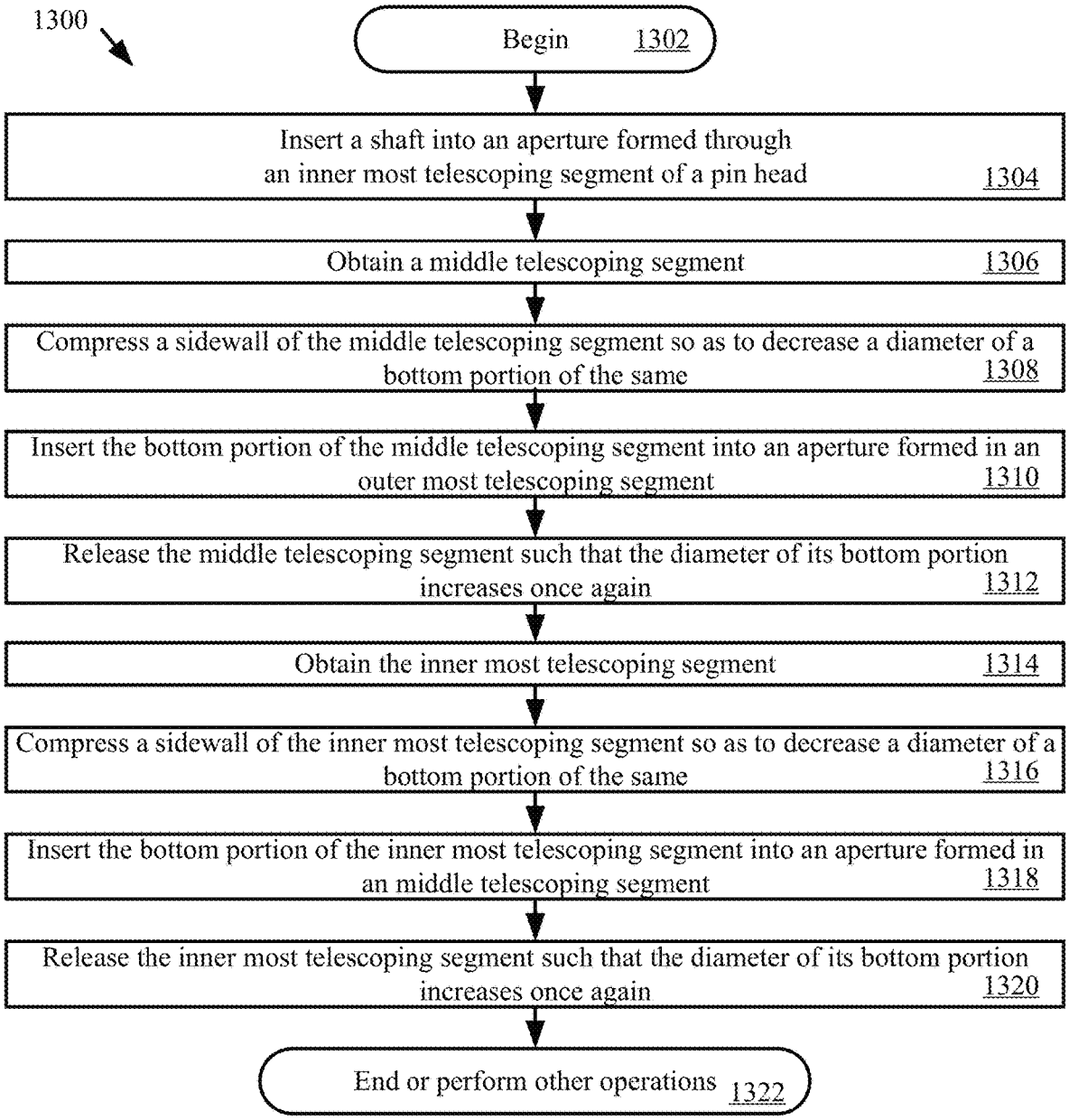
FIG. 13 provides a flow diagram of an illustrative method for assembling a pin.

The above described pin 306 and/or pin 1200 can be assembled in accordance with the process 1300 shown in FIG. 13. Process 1300 is not limited to the order of operations shown in FIG. 13. For example, the operations of 1304 can alternatively be performed after any one of the operations 1306-1320 for inserting a shaft into a pin head and coupling the same together.

As shown in FIG. 13, process 1300 begins with 1302 and continues with 1304 where the shaft 312 is inserted into an aperture (e.g., 1016 of FIG. 10) formed through the inner most telescoping segment (e.g., telescoping 506 of FIG. 5) of the pin head (e.g., pin head 308 of FIG. 3). During this insertion, an interference fit may be created between the shaft (e.g., shaft 312 of FIG. 3) and the inner most telescoping segment (e.g., telescoping segment 506 of FIG. 5).

Next in 1306, a middle telescoping segment (e.g., telescoping segment 504 of FIG. 5) is obtained. The sidewall of the middle telescoping segment is compressed in 1308 such that a diameter (e.g., diameter 1008 of FIG. 10) of the bottom portion (e.g., bottom portion 910 of FIG. 9) of the middle telescoping segment is decreased. One or more apertures (e.g., aperture 512 of FIG. 5) may be formed in the sidewall (e.g., sidewall 514 of FIG. 5) of the of middle telescoping segment so as to facilitate this compression.

At this time, the bottom portion (e.g., 910 of FIG. 9) of the middle telescoping segment is inserted into an aperture (e.g., aperture 914 of FIG. 9) formed in the outer most telescoping segment (e.g., telescoping segment 502 of FIG. 5), as shown by 1310. In 1312, the middle telescoping segment (e.g., telescoping segment 504 of FIG. 5) is released so that the diameter of the bottom portion (e.g., 910 of FIG. 9) increases once again. In this way, the middle telescoping segment (e.g., telescoping segment 504 of FIG. 5) is slidingly coupled to the outer most telescoping segment (e.g., telescoping segment 502 of FIG. 5).

Subsequently, process 1300 continues with 1314-1320. 1314-1316 involve: obtaining the inner most telescoping segment (e.g., telescoping segment 506 of FIG. 5); and compressing a sidewall (e.g., sidewall 516 of FIG. 5) of the inner most telescoping segment so as to decrease a diameter (e.g., diameter 1010 of FIG. 10) of a bottom portion (e.g., bottom portion 904 of FIG. 9) of the same. One or more apertures (e.g., aperture 518 of FIG. 5) may be formed in the sidewall (e.g., sidewall 516 of FIG. 5) of the inner most telescoping segment (e.g., telescoping segment 506 of FIG. 5) so as to facilitate this compression.

At this time, the bottom portion (e.g., bottom portion 904 of FIG. 9) of the inner most telescoping segment (e.g., telescoping segment 506 of FIG. 5) is inserted into an aperture (e.g., aperture 916 of FIG. 9) formed in the inner most telescoping segment (e.g., telescoping segment 506 of FIG. 5), as shown by 1318. In 1320, the inner most telescoping segment (e.g., telescoping segment 506 of FIG. 5) is released so that the diameter of the bottom portion (e.g., bottom portion 904 of FIG. 9) increases once again. In this way, the inner most telescoping segment (e.g., telescoping segment 506 of FIG. 5) is slidingly coupled to the middle telescoping segment (e.g., telescoping segment 504 of FIG. 5). Subsequently, 1322 is performed where method 1300 ends or other operations are performs.

Figure 14:
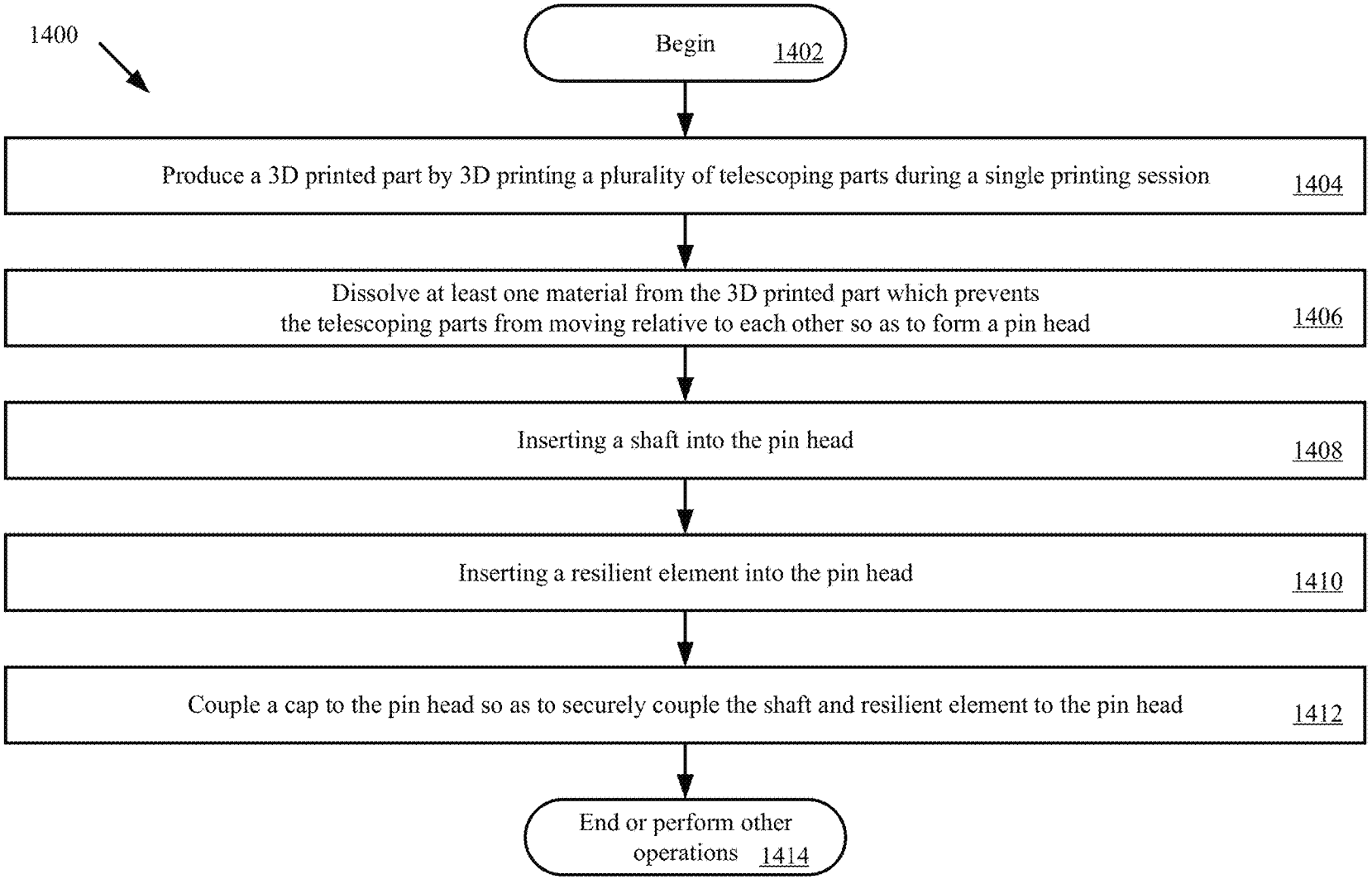
FIG. 14 provides a flow diagram of an illustrative method for making a pin using 3D printing technology.

Referring now to FIG. 14, there is provided a flow diagram of an illustrative method 1400 for making a pin (e.g., pin 306 of FIG. 3) using 3D printing technology. Method 1400 begins with 1402 and continues with 1404 where a 3D printed part is produced by 3D printing a plurality of telescoping parts during a single printing session. In 1406, at least one material is dissolved from the 3D printed part which prevents the telescoping parts from moving relative to each other. A pin head (e.g., pin head 308 of FIG. 8) is produced as a result of this dissolving process. The pin head comprises a plurality of telescoping segments (e.g., telescoping segments 502-506 of FIG. 5) that are slidingly coupled to each other. At least an outer most telescoping segment (e.g., telescoping segment 502 of FIG. 5) rotates relative to an inner most telescoping segment (e.g., telescoping segment 506 of FIG. 5).

Upon completing 1406, method 1400 continues with 1408 where a shaft (e.g., shaft 312 of FIG. 3) is inserted into the pin head. An interference fit may be created between the shaft and the inner most telescoping segment during this insertion process via a press fit. An adhesive may optionally be disposed on a flange (e.g., flange 1018 of FIG. 10) that is provided at a top end of the shaft (e.g., shaft 312 of FIG. 3) so as to facilitate coupling of the shaft to the inner most telescoping segment. Next in 1410, a resilient element (e.g., resilient element 508 of FIG. 5) is inserted into the pin head. In some scenarios, the resilient element comprises a spring that is disposed around the shaft and extends along an elongate length of the shaft. An air gap is provided between the resilient element and the shaft. The present solution is not limited to the particulars of these scenarios.

In 1412, a cap is coupled to a bottom of the outer most telescoping segment (e.g., telescoping segment 502 of FIG. 5) so as to securely couple the shaft and resilient element to the pin head. Caps are well known in the art, and therefore will not be described herein. Any known or to be known cap architecture can be used herein in accordance with a particular application. In some scenarios, the cap threadingly or snappingly engages an inner surface of the outer most telescoping segment. In other scenarios, the cap has an interference fit with the outer most telescoping segment. The present solution is not limited to the particulars of these scenarios. Accordingly, an adhesive or other coupling agent can be used in addition to or as an alternative to a mechanical coupling means. Subsequently, 1414 is performed where method 1400 ends or other operations are performed.

Figure 15:
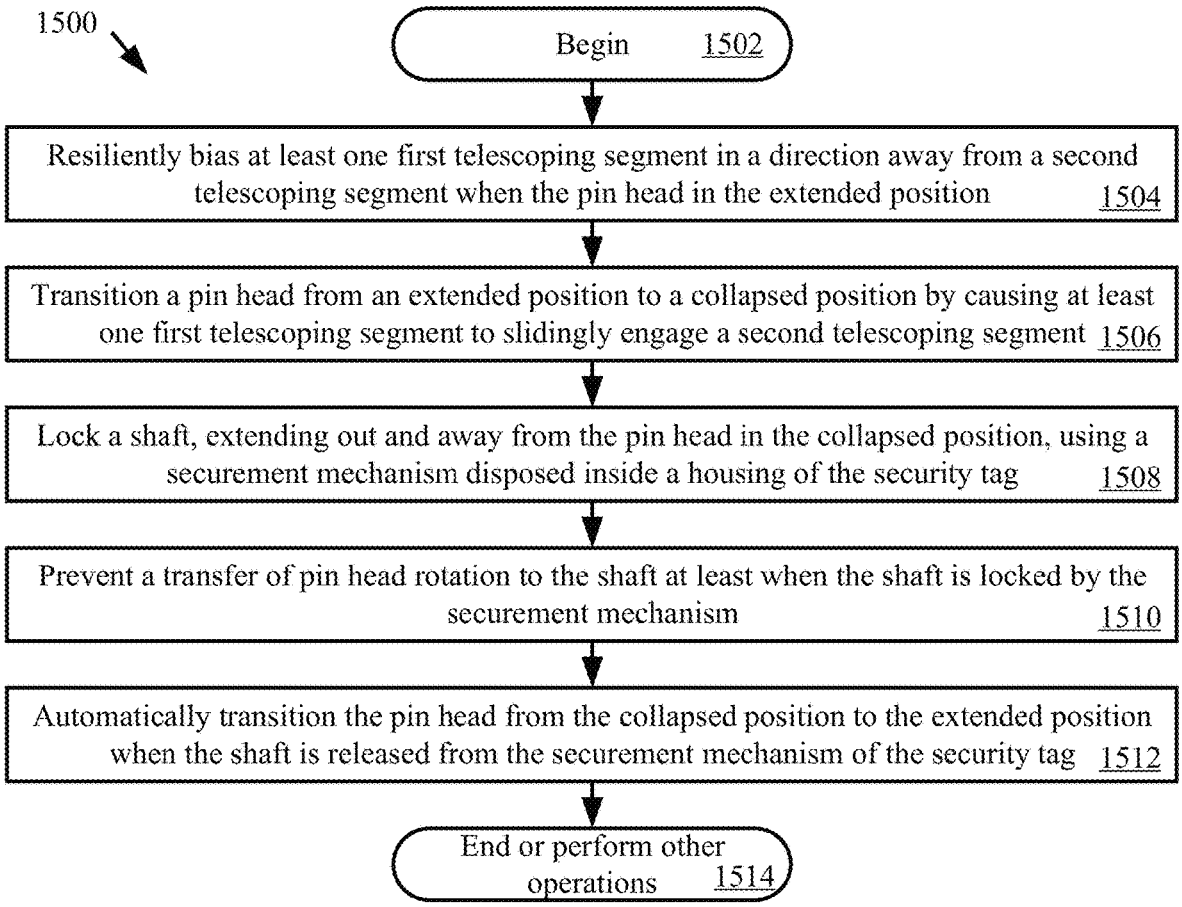
FIG. 15 provides a flow diagram of a method for operating a security tag.

Referring now to FIG. 15, there is provided a flow diagram of an illustrative method 1500 for operating a security tag (e.g., security tag 108 of FIG. 1 or 300 of FIG. 3). Method 1500 begins with 1502 and continues with 1504 where at least one first telescoping segment (e.g., telescoping segment 506 of FIG. 6) is resiliently biased in a direction away from the second telescoping segment (e.g., telescoping segment 502 or 504 of FIG. 5) when the pin head (e.g., pin head 308 of FIG. 3) in the extended position (e.g., shown in FIG. 5). The first and second telescoping segments may be created together during a single 3D printing process or session.

Next in 1506, the pin head is transitioned from an extended position to a collapsed position (e.g., shown in FIG. 7) by causing at least one first telescoping segment to slidingly engage a second telescoping segment. In 1508, a shaft (e.g., shaft 312 of FIG. 3) is locked using a securement mechanism (e.g., a clamp or 3 ball clutch) disposed inside a housing of the security tag. The shaft extends out and away from the pin head in the collapsed position. The shaft may be entirely disposed within the pin head when the pin head is in the extended position.

A transfer of pin head rotation to the shaft is prevented at least when the shaft is locked by the securement mechanism, as shown by 1510. In some scenarios, the pin head rotation is prevented from being transferred to the shaft by allowing the second telescoping segment to freely rotate relative to or around the at least one first telescoping segment. In other scenarios, the pin head rotation is prevented from being transferred to the shaft by allowing the pin head to rotate freely relative to or around the shaft.

In 1512, the pin head is automatically transitioned from the collapsed position to the extended position when the shaft is released from the securement mechanism of the security tag. The automatic transitioning is achieved using a resilient member (e.g., resilient member 508 of FIG. 5) disposed within the pin head. The resilient member may be disposed around the shaft.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method for operating a security tag, comprising:

transitioning a pin head from an extended position to a collapsed position by causing at least one first telescoping segment of the pin head to slidingly engage a second telescoping segment of the pin head;

locking a shaft, extending out and away from the pin head in the collapsed position, using a securement mechanism disposed inside a housing of the security tag; and preventing a transfer of pin head rotation to the shaft at least when the shaft is locked by the securement mechanism.

2. The method according to claim 1, further comprising resiliently biasing the at least one first telescoping segment in a direction away from the second telescoping segment when the pin head is in the extended position.

3. The method according to claim 1, further comprising automatically transitioning the pin head from the collapsed position to the extended position when the shaft is released from the securement mechanism of the security tag.

4. The method according to claim 1, wherein the automatic transitioning is achieved using a resilient member disposed within the pin head.

5. The method according to claim 4, wherein the resilient member is disposed around the shaft.

6. The method according to claim 1, wherein the shaft is entirely disposed within the pin head when the pin head is in the extended position.

7. The method according to claim 1, wherein the pin head rotation is prevented from being transferred to the shaft by allowing the second telescoping segment to freely rotate relative to the at least one first telescoping segment.

8. The method according to claim 1, wherein the pin head rotation is prevented from being transferred to the shaft by allowing the pin head to rotate freely relative to the shaft.

9. The method according to claim 1, wherein an interference fit is provided between the shaft and the at least one first telescoping segment.

10. The method according to claim 1, wherein the at least one first telescoping segment and the second telescoping segment are created together during a single 3D printing process.

11. A security tag, comprising:

a housing having an internal securement mechanism;

a pin sized and shaped to be at least partially and removably inserted into the housing, the pin comprising:

a pin head comprising a plurality of telescoping segments that are transitionable from an extended position to a collapsed position when at least one first telescoping segment of the plurality of telescoping segments of the pin head is caused to slidingly engage a second telescoping segment of the plurality of telescoping segments of the pin head; and a shaft that is coupled to the pin head, extends out and away from the pin head in the collapsed position, and is able to be locked inside the housing using the internal securement mechanism;

wherein a transfer of pin head rotation to the shaft is prevented at least when the shaft is locked by the securement mechanism.

12. The security tag according to claim 11, wherein the at least one first telescoping segment is resiliently biased in a direction away from the second telescoping segment when the pin head is in the extended position.

13. The security tag according to claim 11, wherein the pin head is automatically transitioned from the collapsed position to the extended position when the shaft is released from the securement mechanism of the security tag.

14. The security tag according to claim 11, wherein the pin head is automatically transitioned to the extended position using a resilient member disposed within the pin head.

15. The security tag according to claim 14, wherein the resilient member is disposed around the shaft.

16. The security tag according to claim 11, wherein the shaft is entirely disposed within the pin head when the pin head is in the extended position.

17. The security tag according to claim 11, wherein the pin head rotation is prevented from being transferred to the shaft by allowing the second telescoping segment to freely rotate relative to the at least one first telescoping segment.

18. The security tag according to claim 11, wherein the pin head rotation is prevented from being transferred to the shaft by allowing the pin head to rotate freely relative to the shaft.

19. The security tag according to claim 11, wherein an interference fit is provided between the shaft and the at least one first telescoping segment.

20. The security tag according to claim 11, wherein the at least one telescoping segment and the second telescoping segment are created together during a single 3D printing process.

* * * * *